US008581683B2

(12) United States Patent
Hoppe et al.

(10) Patent No.: US 8,581,683 B2
(45) Date of Patent: Nov. 12, 2013

(54) ELECTROMAGNETIC ACTUATING UNIT OF A HYDRAULIC DIRECTIONAL VALVE

(75) Inventors: Jens Hoppe, Erlangen (DE); Markus Kinscher, Adelsdorf (DE)

(73) Assignee: Shaeffler Technologies AG & Co. KG, Herzogenaurach (DE)

( * ) Notice: Subject to any disclaimer, the term of this patent is extended or adjusted under 35 U.S.C. 154(b) by 321 days.

(21) Appl. No.: 13/055,160

(22) PCT Filed: Jul. 3, 2009

(86) PCT No.: PCT/EP2009/058405

§ 371 (c)(1),
(2), (4) Date: Jan. 21, 2011

(87) PCT Pub. No.: WO2010/009966

PCT Pub. Date: Jan. 28, 2010

(65) Prior Publication Data

US 2011/0121218 A1 May 26, 2011

Related U.S. Application Data

(60) Provisional application No. 61/082,905, filed on Jul. 23, 2008.

(30) Foreign Application Priority Data

Aug. 8, 2008 (DE) ..... 10 2008 037 076

(51) Int. Cl.
*H01F 3/00* (2006.01)

(52) U.S. Cl.
USPC ..... 335/262; 335/220; 251/129.15

(58) Field of Classification Search
USPC ..... 335/220–229, 255, 261, 262; 251/129.15–129.19
See application file for complete search history.

(56) References Cited

U.S. PATENT DOCUMENTS

| | | | | |
|---|---|---|---|---|
| 4,142,169 | A | 2/1979 | Katchka et al. | |
| 4,919,390 | A * | 4/1990 | Ichiryu et al. | 251/129.15 |
| 5,050,840 | A | 9/1991 | Kondo et al. | |
| 6,065,734 | A | 5/2000 | Tackett et al. | |
| 7,458,395 | B2 * | 12/2008 | Haynes et al. | 137/625.65 |

FOREIGN PATENT DOCUMENTS

| | | | |
|---|---|---|---|
| DE | 27 458 | A | 3/1964 |
| DE | 31 47 062 | A1 | 6/1983 |
| DE | 10 2005 048 732 | A1 | 4/2007 |
| DE | 10 2005 051 177 | A1 | 5/2007 |
| DE | 10 2006 027 349 | A1 | 12/2007 |

* cited by examiner

*Primary Examiner* — Bernard Rojas
(74) *Attorney, Agent, or Firm* — Lucas & Mercanti, LLP

(57) ABSTRACT

An electromagnetic actuating unit of a hydraulic directional valve, which has an armature and a first and a second magnet yoke. The first and the second magnet yokes at least partially bind an armature space, the armature is arranged in the armature space so as to be axially displaceable, and the first and the second magnet yokes face each other in the axial direction of the armature.

12 Claims, 3 Drawing Sheets

ELECTROMAGNETIC ACTUATING UNIT OF A HYDRAULIC DIRECTIONAL VALVE

This application is a 371 of PCT/EP2009/058405 filed on Jul. 3, 2009, which in turn claims the priority of U.S. 61/082,905 filed Jul. 23, 2008 and DE 10 2008 037 076.2filed Aug. 8, 2008,the priority of these applications is hereby claimed and these applications are incorperated by reference herein.

FIELD OF THE INVENTION

The invention relates to an electromagnetic actuating unit of a hydraulic directional valve, having an armature and a first and a second magnet yoke, wherein the first and the second magnet yoke at least partially delimit an armature space, wherein the armature is arranged in the armature space so as to be axially movable, and wherein the first and the second magnet yoke face each other in the axial direction of the armature.

Directional valves of this kind are used in internal combustion engines, for example, in order, for example, to control switchable cam followers, e.g. switchable bucket tappets, roller tappets or finger followers, or hydraulic camshaft adjusters. The directional valves comprise an electromagnetic actuating unit and a valve section. The valve section represents the hydraulic section of the directional valve, and at least one inlet port, at least one working port and a tank port are formed on said section. By means of the electromagnetic actuating unit, it is possible to connect certain ports of the valve section hydraulically to each other and thus direct the flows of pressure medium.

Directional valves of this kind can be of one-piece design, in which case the electromagnetic actuating unit is connected in a fixed manner to the valve section. In these cases, the directional valve is positioned in a receptacle formed, for example, on a cylinder head or a cylinder head cover, and is connected to the pressure chambers of the camshaft adjuster by pressure medium lines.

In another embodiment, the electromagnetic actuating unit and the valve section are embodied as separate components. Here, it is conceivable, for example, to arrange the valve section within a receptacle which is formed on an inner rotor, a camshaft or an extension of the camshaft. In this case, the valve section is arranged coaxially with respect to the camshaft and the inner rotor and rotates jointly therewith about the common axis of rotation.

The electromagnetic actuating unit is arranged axially with respect to the valve section and is secured in a fixed location, e.g. on a chain case or the like. The electromagnetic actuating unit controls the axial position of a tappet rod which, in turn, controls the axial position of a control plunger of the valve section.

For the application of a directional valve to the control of a camshaft adjuster, said valve is normally designed as a 4/3- or 4/2-way proportional valve. A proportional valve of this kind is known from DE 10 2005 048 732 A1, for example. In this case, the electromagnetic actuating unit comprises a first and a second magnet yoke, a coil, a housing, an armature and a connection element, which accommodates an electric plug connection used to supply power to the coil.

The coil, the first and the second magnet yoke are arranged in mutually coaxial positions within the housing of the electromagnetic actuating unit. The first and the second magnet yoke form an armature space. Arranged within the armature space is an armature which can be moved in the axial direction and to which is attached a tappet rod that reaches through an opening in the second magnet yoke and is supported in the radial direction in said opening. The armature, the housing, the first and the second magnet yoke form a flux path for the magnetic flux lines caused by energization of the coil.

The valve section comprises a valve housing and a control plunger arranged so as to be axially movable therein. The valve housing is arranged within an inner rotor of a camshaft adjuster. Arranged on the inner rotor is an outer rotor, which is supported in such a way that it can be rotated relative to the latter and, in the embodiment illustrated, is in drive connection with a crankshaft by means of a chain drive.

A plurality of pressure medium ports, which act as the inlet port, the drain port and working ports, are formed on the outer circumferential surface of the valve housing. The working ports communicate with pressure chambers which counteract each other and are formed within the camshaft adjuster.

A control plunger is arranged so as to be axially movable within the valve housing, the outside diameter of the control plunger being matched to the inside diameter of the valve housing. Annular grooves, via which adjacent pressure medium ports can be connected to each other, are formed in the outer circumferential surface of the control plunger.

Energizing the coil pushes the armature in the direction of the valve section, and this movement is transmitted to the control plunger by means of a tappet rod attached to the armature. Said plunger is now moved in the axial direction counter to a spring supported against the valve housing, thereby directing the flow of pressure medium from the inlet port to one of the working ports and from the other working port to the drain port. Pressure medium is thereby fed to or removed from the pressure chambers of the camshaft adjuster, thereby enabling the phase position of the camshaft relative to a crankshaft to be varied.

The first and the second magnet yoke face each other in the axial direction, being separated by an air gap. Arranged within the first magnet yoke is a cup-shaped armature guide sleeve, in which the armature is supported. The armature guide sleeve rests on an inner circumferential surface of the first magnet yoke, and the second magnet yoke is inserted into the armature guide sleeve.

The disadvantage with this embodiment is that there is a relatively large clearance between the armature and the second magnet yoke owing to the armature guide sleeve. As a result, transfer of the magnetic field lines from the armature to the first magnet yoke is impaired, leading to a reduction in the force exerted on the armature. Consequently, the coil must be designed for higher currents in order to achieve the required performance of the actuating unit, and this leads to higher production costs. Moreover, the currents flowing in the coil during operation are higher, leading to the generation of more heat.

DE 10 2006 027 349 A1 shows another embodiment of an electromagnetic actuating unit. In this embodiment, the armature is mounted on a pin, which is secured on the first magnet yoke, on the one hand, and engages in a hole in the armature in the axial direction. This leads to an increase in the number of components and in the tolerance chain between the components.

SUMMARY OF THE INVENTION

It is therefore the underlying object of the invention to avoid these disadvantages which have been described and thus to provide an electromagnetic actuating unit while improving the performance of the latter.

According to the invention, the object is achieved by virtue of the fact that a plain bearing resting on the armature is arranged on an outer circumferential surface of the armature or an inner circumferential surface of the first or of the second magnet yoke to support the armature on the magnet yoke, wherein, in any position of the armature relative to the magnet yoke, the plain bearing is arranged outside the region in which ends of the first magnet yoke and of the second magnet yoke face each other.

The electromagnetic actuating unit of a hydraulic directional valve has a magnetic circuit which comprises at least one armature and a first and a second magnet yoke. The first magnet yoke is arranged axially offset with respect to the second magnet yoke. An air gap may be provided between facing ends of these two components. The first and the second magnet yoke at least partially surround an armature space. The armature is arranged so as to be axially movable in the armature space. The armature and the first and the second magnet yoke form a magnetic circuit, which is completed by additional components, e.g. a housing of the actuating unit. The actuating unit generally accommodates a coil. Energizing the coil exerts on the armature a force which pushes the latter into the region in which the ends of the first and the second magnet yoke face each other.

A plain bearing is provided on the armature or on the first or second magnet yoke in order to provide low-friction support for the armature in the armature space. The plain bearing may be secured on the armature. In this case, the plain bearing rests in a fixed location on the armature. Embodiments in which the plain bearing is secured on the first or the second magnet yoke are equally conceivable. The plain bearing is arranged in such a way that the plain bearing rests on the armature in any position of the armature within the armature space. The plain bearing reduces the friction between the armature and the magnet yoke and thus significantly reduces the hysteresis of the characteristic of the electromagnetic actuating unit.

If the plain bearing is secured on the armature, it is advantageously arranged in such a way that it does not enter the region in which the two ends of the first and the second magnet yoke face each other, in particular does not cover the region of the air gap, in any position of the armature in the armature space.

If the the plain bearing is secured on the magnet yoke, it is advantageously arranged in such a way that it assumes the function of supporting the armature in any position of the latter but, at the same time, is arranged at the maximum distance from the region in which the ends of the first and the second magnet yoke face each other.

The advantage of this arrangement consists in that the force on the armature produced by the magnetic field of the coil is not attenuated. In the region in which the ends of the first and the second magnet yoke face each other, the magnetic field passes from the first magnet yoke into the armature and on into the second magnet yoke. The invention makes it possible to reduce to a minimum the radial clearances between the armature and the first and second magnet yoke. Moreover, no additional component is provided between the armature and the magnet yoke at the crossing points. The passage of the flux lines can thus be accomplished in an optimum manner, leading to optimum conversion of the magnetic field into a force on the armature. The maximum current required falls and the same amount of force is developed.

In a development of the invention, a first recess, in which the plain bearing is arranged, is provided in the outer circumferential surface of the armature or the inner circumferential surface of the first or of the second magnet yoke. In this arrangement, the first recess can be designed as a groove which runs around in the circumferential direction. For example, the outer circumferential surface of the armature may be provided with an annular groove at one axial end. The plain bearing can be pushed onto the shoulder thereby formed or mounted on the latter in some other way in a manner such that it projects by a minimal amount. In this way, the radial clearance between the armature and the magnet yoke can be further reduced and the force acting on the armature can thus be increased.

Provision can furthermore be made for a second recess, which faces the first recess in the radial direction, to be provided in that component, selected from the group comprising the armature or the magnet yoke, on which the plain bearing is not secured. The plain bearing arranged in the first recess also engages in the second recess. In this way, the radial clearance between the armature and the magnet yoke can be further reduced and the force acting on the armature can thus be increased.

The plain bearing can be of annular or segmented design, for example.

The plain bearing can furthermore be provided with a stop, which limits the travel of the armature in one direction. In this way, it is possible to achieve limitation of armature travel without additional components. In this arrangement, provision can be made for the stop to cover the surface of the armature only partially, perpendicularly to the direction of motion of the latter. This prevents the armature from coming to rest flat against one end of the armature space. The armature is thereby prevented from sticking to the surface, and this has a positive effect on the hysteresis of the characteristic and reduces the force required.

The plain bearing can, for example, be secured nonpositively, positively or by a material bond on the armature or the magnet yoke.

The plain bearing can be secured on the armature or the magnet yoke by means of a press fit, an adhesive bond or a soldered joint. Embodiments in which the plain bearing is caulked to the armature or the magnet yoke or molded onto the armature or the magnet yoke are equally conceivable.

The plain bearing can be produced as a separate component and connected subsequently to the respective component or can be molded directly onto the latter.

BRIEF DESCRIPTION OF THE DRAWINGS

Further features of the invention will become apparent from the following description and from the drawings, in which illustrative embodiments of the invention are shown in simplified form. In the drawings.

DETAILED DESCRIPTION OF THE DRAWING

Figure 2:
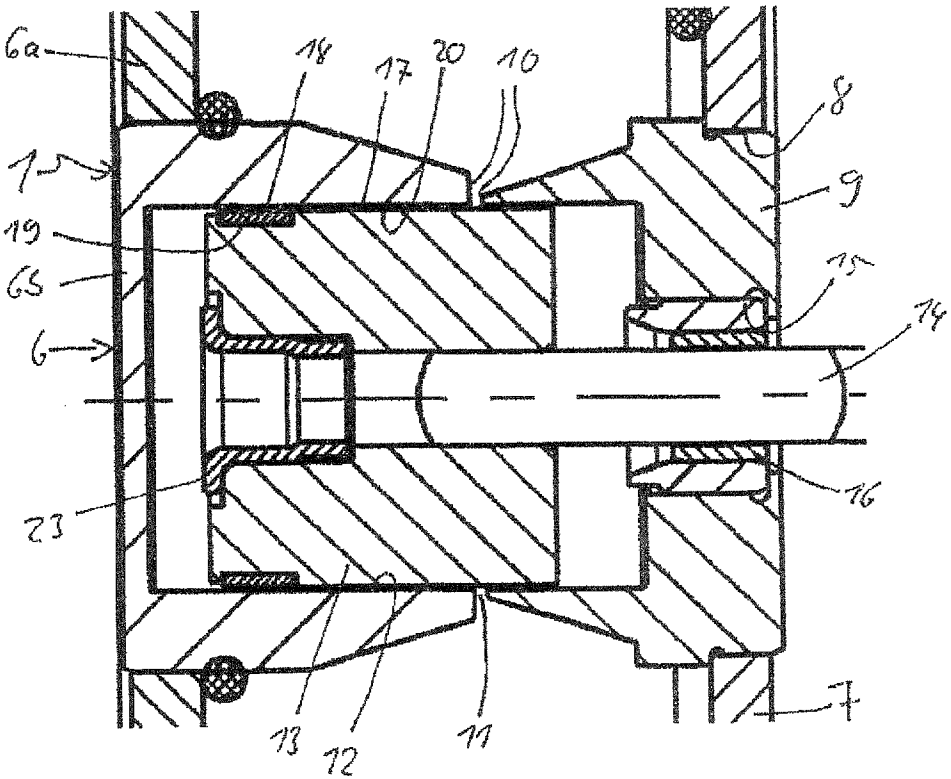
FIG. 2 shows an enlarged illustration of the electromagnetic actuating unit from FIG. 1.
Figure 1:
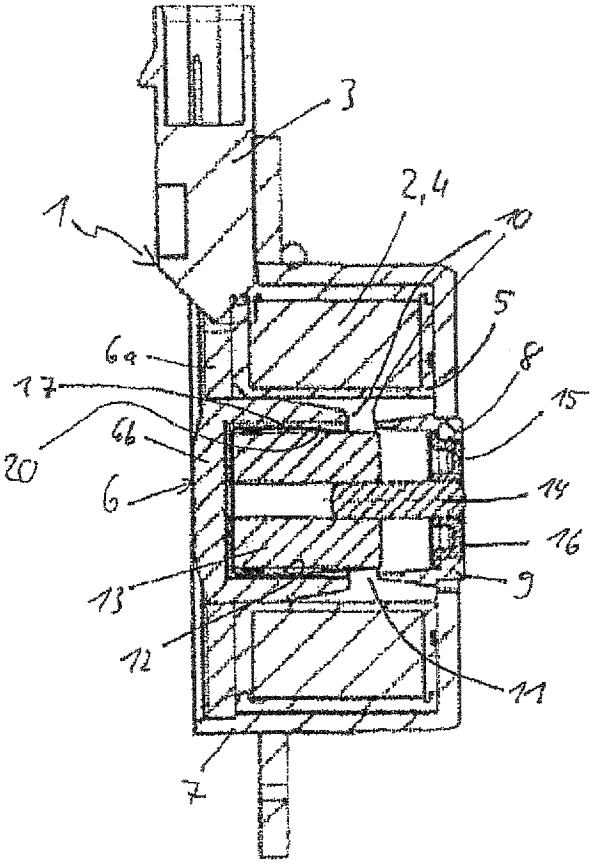
FIG. 1 shows a first embodiment of an electromagnetic actuating unit in longitudinal section.

FIGS. 1 and 2 show a first embodiment according to the invention of an electromagnetic actuating unit 1 in longitudinal section. The electromagnetic actuating unit 1 has a coil form 2 and a connection element 3 constructed in one piece with the latter. The coil form 2 carries a coil 4 consisting of a plurality of windings made from a suitable wire and is at least partially surrounded by an encapsulation 5 made of nonmagnetizable material. Arranged within the encapsulation 5 is a first magnet yoke 6, which has a disk-type and a sleeve-type section 6*a*, 6*b* in the embodiment illustrated. The sleeve-type section 6*b* engages in a cavity radially within the encapsulation 5 of the coil 4, the outside diameter thereof being matched to the inside diameter of the encapsulation 5. The disk-type section 6*a* comes to rest in the axial direction against the encapsulation 5 and thus determines the axial position of the first magnet yoke 6.

The coil form 2 is furthermore arranged in a cup-shaped housing 7, in the base of which a mounting opening 8 is provided. Accommodated in the mounting opening 8 is a second magnet yoke 9, which projects in the axial direction into the encapsulation 5. In this arrangement, the open ends 10 of the first and the second magnet yoke 6, 9 face each other axially across an air gap 11.

The first and the second magnet yoke 6, 9 delimit an armature space 12, in which an axially movable armature 13 is arranged. A tappet rod 14 connected to the armature 13 extends through an opening 15 formed in the second magnet yoke 9 and, in the assembled condition of the actuating unit 1, one end of the tappet rod 14 rests against a control plunger (not shown) of the directional valve. A sliding sleeve 16 may be provided within the opening 15 in order to minimize frictional losses at this point.

During operation, the energization of the actuating unit 1 is controlled, thereby generating a magnetic field within the actuating unit 1. The first magnet yoke 6, the housing 7, the second magnet yoke 9 and the armature 13 here serve as a flux path, which is completed by the air gap 11 between the armature 13 and the first and second magnet yoke 6, 9. In this arrangement, a force acts on the armature 13 in the direction of the second magnet yoke 9, this force being dependent on the level of energization of the coil 4. The armature 13 and hence the control plunger can be positioned in any desired position between two extreme positions by balancing the magnetic force acting on the armature 13 and a spring force acting on the control plunger.

An annular plain bearing 18 is provided on the outer circumferential surface 17 of the armature 13. For this purpose, the armature 13 has a first recess 19 in the form of an annular groove, in which the plain bearing 18 is arranged. The plain bearing 18 projects by only a small amount relative to the outer circumferential surface 17 of the armature 13 and rests on an inner circumferential surface 20 of the first magnet yoke 6. At the same time, the plain bearing 18 is arranged in such a way that it does not enter the region of the air gap 11 separating the mutually facing ends 10 of the first and the second magnet yoke 6, 9 in any position of the armature 13 relative to the first magnet yoke 6. The flux lines of the magnetic field can thus cross between the armature 13 and the magnet yoke 6, 9 in an optimum manner in the region of the air gap 11 since there is no component arranged between them and the radial clearances are small. The force acting on the armature 13 is thus optimized. The arrangement of the plain bearing 18 on the armature 13 eliminates the need for a recess in the thin-walled first magnet yoke 6, which would lead to a reduction in force owing to the disturbance of the magnetic flux due to the constriction of the flux path. The first recess 19 in the armature 13 imposes virtually no disturbance on the magnetic flux since this component is of solid construction.

Equally conceivable are embodiments in which the inner circumferential surface 20 of the first magnet yoke 6 has a recess 19 in which a plain bearing 18 is arranged or in which the plain bearing 18 is designed as a thin layer on the outer circumferential surface 17 of the armature 13 or the inner circumferential surface 20 of the first magnet yoke 6, the layer being arranged in such a way that it does not enter the air gap 11 in any position of the armature 13 but always rests on the armature 13.

At the end of the armature 13 remote from the tappet rod 14, is a stop sleeve 23, which is arranged in an axial bore in the armature 13. The stop sleeve 23 projects from the end of the armature 13 in the axial direction, although it does not completely cover said end. The stop sleeve 23 thus limits a travel of the armature 13 in one of the two directions of motion. At the same time, the stop sleeve 23 prevents the end of the armature 13 coming to rest flat against the first magnet yoke 6. This avoids the need for a higher force to move the armature 13 out of this position owing to adhesion.

Figure 3:
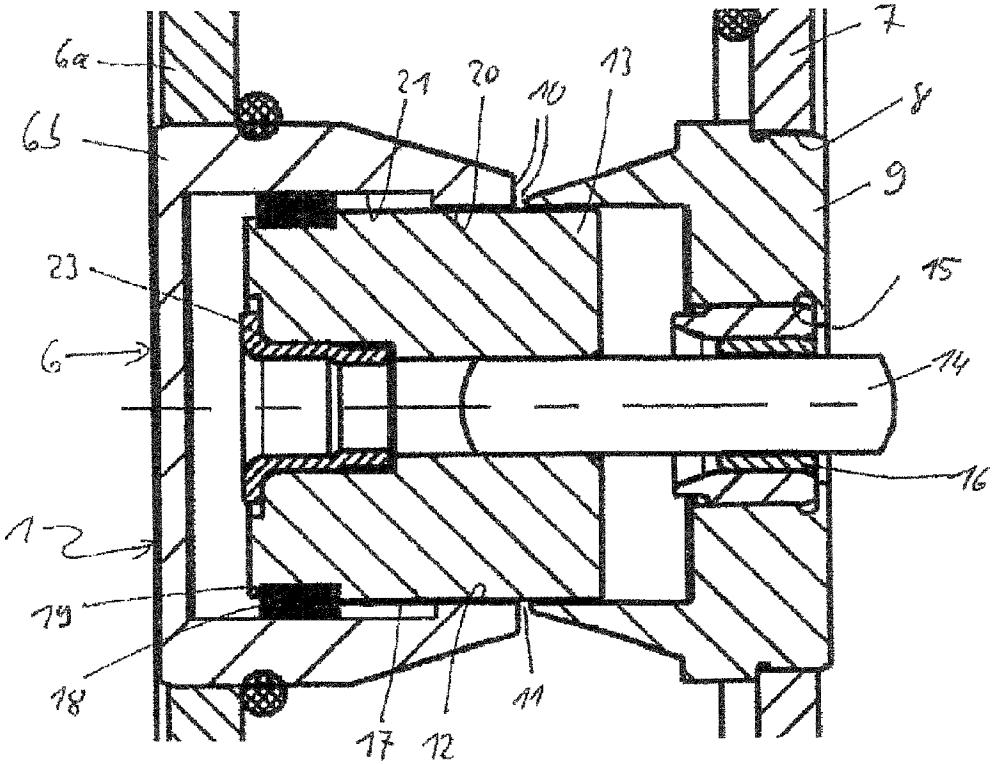
FIG. 3 shows an illustration of a second embodiment of an electromagnetic actuating unit similar to that in FIG. 2.

FIG. 3 shows a second embodiment of an electromagnetic actuating unit 1. In contrast to the first embodiment, the first magnet yoke 6 here has a second recess 21 in the region of the plain bearing 18, said recess likewise being in the form of an annular groove in this embodiment. The plain bearing 18 is arranged in the first recess 19 and is secured on the armature 13. At the same time, it engages in the second recess 21. In this arrangement, the axial length of the second recess 21 is made such that it does not hinder the movement of the armature 13. The design of the two recesses 19, 21 allows a further reduction in the radial clearance between the armature 13 and the first and second magnet yoke 6, 9. Embodiments in which the plain bearing 18 is secured on the first magnet yoke 6 and the second recess 21 is formed in the armature 13 are equally conceivable.

Figure 5:
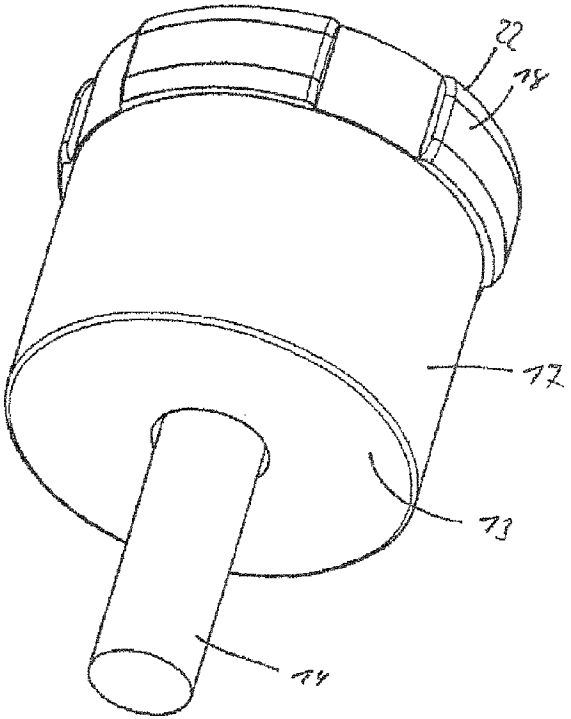
FIG. 5 shows the armature from FIG. 4 in a perspective view.
Figure 4:
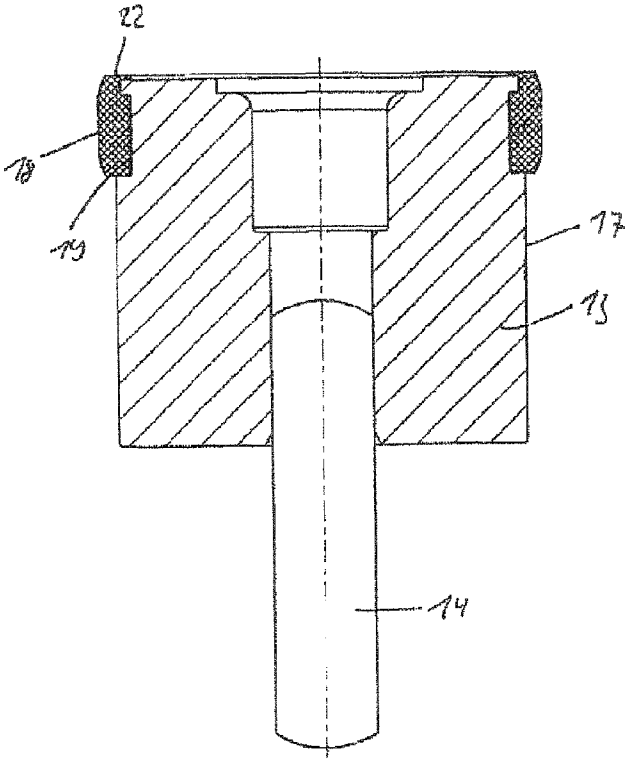
FIG. 4 shows an armature of a third embodiment of an actuating unit according to the invention in longitudinal section.

FIGS. 4 and 5 show the armature 13 of a third embodiment according to the invention of an electromagnetic actuating unit 1. In contrast to the second embodiment, the plain bearing 18 is not annular but is of segmented design. This allows communication between the spaces axially in front of and behind the armature 13. When the armature 13 is moved, air or lubricant can thus be conveyed between the spaces and, in this way, a pressure buildup can be avoided. In addition, it is easier for lubricant to reach the plain bearing locations.

In addition, a stop 22 is formed in one piece on the plain bearing 18 in this embodiment, said stop assuming the function of stop sleeve 23. The number of components for the actuating unit 1 and hence the costs and outlay on the assembly thereof are thus reduced.

LIST OF REFERENCE SIGNS

1 Actuating unit
2 Coil form
3 Connection element
4 Coil
5 Encapsulation
6 First magnet yoke
6*a* Disk-type section
6*b* Sleeve-type section
7 Housing
8 Mounting opening
9 Second magnet yoke
10 End
11 Air gap
12 Armature space
13 Armature
14 Tappet rod
15 Opening
16 Sliding sleeve
17 Outer circumferential surface
18 Plain bearing
19 First recess

20 Inner circumferential surface
21 Second recess
22 Stop
23 Stop sleeve

The invention claimed is:

1. An electromagnetic actuating unit of a hydraulic directional valve, comprising:

an armature, a first magnet yoke, and a second magnet yoke, a tappet rod connected to the armature extends through an opening in the second magnetic yoke, wherein the first magnet yoke and the second magnet yoke at least partially delimit an armature space, wherein the armature is arranged in the armature space so as to be axially movable, wherein the first magnet yoke and the second magnet yoke face each other in an axial direction of the armature, wherein a plain bearing resting on the armature is arranged on an outer circumferential surface of the armature or an inner circumferential surface of one of the first magnet yoke and the second magnet yoke to support the armature on the one of the first magnet yoke and the second magnet yoke, and wherein, in any position of the armature relative to the one of the first magnet yoke and the second magnet yoke, the plain bearing is arranged outside a region in which ends of the first magnet yoke and of the second magnet yoke face each other.

2. The electromagnetic actuating unit as claimed in claim 1, wherein a first recess, in which the plain bearing is arranged, is provided on the outer circumferential surface of the armature or the inner circumferential surface of the one of the first magnet yoke and the second magnet yoke.

3. The electromagnetic actuating unit as claimed in claim 2, wherein the first recess is designed as a groove which runs around in a circumferential direction.

4. The electromagnetic actuating unit as claimed in claim 2, wherein a second recess, which faces the first recess in a radial direction, is provided in that component, selected from a group comprising the armature the one of the first magnet yoke and the second magnet yoke, on which the plain bearing is not secured.

5. The electromagnetic actuating unit as claimed in claim 1, wherein the plain bearing has a stop, which limits a travel of the armature in one direction.

6. The electromagnetic actuating unit as claimed in claim 5, wherein the stop covers a surface of the armature only partially, perpendicularly to a direction of motion of the armature.

7. The electromagnetic actuating unit as claimed in claim 1, wherein the plain bearing is of annular design.

8. The electromagnetic actuating unit as claimed in claim 1, wherein the plain bearing is of segmented design.

9. The electromagnetic actuating unit as claimed in claim 1, wherein the plain bearing is secured nonpositively, positively or by a material bond on the armature or the one of the first magnet yoke and the second magnet yoke.

10. The electromagnetic actuating unit as claimed in claim 1, wherein the plain bearing is secured on the armature or the magnet yoke by means of a press fit.

11. The electromagnetic actuating unit as claimed in claim 1, wherein the plain bearing is caulked to the armature or the magnet yoke.

12. The electromagnetic actuating unit as claimed in claim 1, wherein the plain bearing is molded onto the armature or the magnet yoke.

* * * * *